US010208963B2

(12) United States Patent
Lee et al.

(10) Patent No.: US 10,208,963 B2
(45) Date of Patent: Feb. 19, 2019

(54) COOKING APPLIANCE

(71) Applicant: LG ELECTRONICS INC., Seoul (KR)

(72) Inventors: Sangkyun Lee, Seoul (KR); Jaebong Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 458 days.

(21) Appl. No.: 15/151,702

(22) Filed: May 11, 2016

(65) Prior Publication Data

US 2016/0334113 A1 Nov. 17, 2016

(30) Foreign Application Priority Data

May 12, 2015 (KR) ..... 10-2015-0065722

(51) Int. Cl.
*F24C 15/08* (2006.01)
*F24C 15/00* (2006.01)

(52) U.S. Cl.
CPC ..... *F24C 15/08* (2013.01); *F24C 15/007* (2013.01)

(58) Field of Classification Search
CPC ..... F24C 15/08; F24C 15/007; F26B 25/12
See application file for complete search history.

(56) References Cited

U.S. PATENT DOCUMENTS 2,434,811 A * 1/1948 Rogers ..... F24C 15/08 126/211
8,546,735 B2 * 10/2013 Choi ..... H05B 6/6485 126/21 A
2012/0281374 A1 * 11/2012 Lee ..... F24C 7/082 361/756

FOREIGN PATENT DOCUMENTS

| | | |
|---|---|---|
| JP | 2011-196643 | 10/2011 |
| KR | 20-1995-0006076 | 7/1995 |
| KR | 20-0138686 | 3/1999 |
| KR | 10-2009-0082624 | 7/2009 |

OTHER PUBLICATIONS

Korean Notice of Allowance in Korean Application No. 10-2015-0065722, dated Feb. 22, 2017, 1 page.

* cited by examiner

*Primary Examiner* — Alfred Basichas
(74) *Attorney, Agent, or Firm* — Fish & Richardson P.C.

(57) ABSTRACT

A cooking appliance may include a cabinet with a cavity that defines a cooking space, an upper panel disposed above the cavity and that is configured to define an upper appearance of the cooking appliance, a front panel disposed in front of the cavity and that is configured to define a front appearance of the cooking appliance, a door that is configured to open and close the cavity, a side panel that is disposed on a side of the cavity and that is configured to define a side appearance of the cooking appliance, a rear panel that is disposed behind the cavity and that is configured to define a rear appearance of the cooking appliance, and a frame bracket that is mounted to a front upper portion of the cabinet and that is configured to secure the upper and front panels to the cabinet.

22 Claims, 9 Drawing Sheets

COOKING APPLIANCE

This application claims the benefit of Korean Patent Application No. 10-2015-0065722, filed on May 12, 2015, which is hereby incorporated by reference as if fully set forth herein.

BACKGROUND

A cooking appliance is a household electric appliance used for heating and cooking food. A cooking appliance that includes a cavity or a chamber for cooking food is generally referred to as an oven or range.

The cavity, which constitutes the framework of a cooking appliance, may be considered to be a structure defining a closed space for heating foodstuffs using a heater. The cavity is generally manufactured from iron plates. In this case, the cavity is generally coated with porcelain enamel for ease of cleaning.

SUMMARY

Accordingly to one aspect a cooking appliance may include a cabinet with a cavity that defines a cooking space, an upper panel that is disposed above the cavity and that is configured to define an upper appearance of the cooking appliance, a front panel that is disposed in front of the cavity and that is configured to define a front appearance of the cooking appliance, a door that is configured to open and close the cavity, that is disposed below the front panel and that is configured to define, in conjunction with the front panel, the front appearance of the cooking appliance, a side panel that is disposed on a side of the cavity and that is configured to define a side appearance of the cooking appliance, a rear panel that is disposed behind the cavity and that is configured to define a rear appearance of the cooking appliance, and a frame bracket that is mounted to a front upper portion of the cabinet and that is configured to secure the upper and front panels to the cabinet.

Implementations according to this aspect may include one or more of the following features. For example, the frame bracket may be coupled to the side panel and is configured to secure the upper panel, the front panel and the side panel to the cabinet. The cooking appliance may include a link support, where a first end of the link support is coupled to the frame bracket, and a second end of the link support is coupled to the rear panel. The frame bracket may include a pair of frame brackets each respectively provided on the lateral sides of the cavity. The frame bracket may be a single body. The frame bracket may include a cabinet coupling portion that is configured to couple to the cabinet from outside the cabinet. The cavity coupling portion may be configured to be in surface contact with a side flange located at a front portion of the cavity. The side flange may include a through hole, and the cabinet coupling portion includes a fitting rib that is configured to fit into the through hole. The cabinet coupling portion may include a coupling hole above the fitting rib, and the side flange includes a coupling hole that is configured to correspond the coupling hole of the cabinet coupling portion. The side flange may be configured to bent in a rearward direction from an outer edge of a front flange located at a front surface of the cavity, and the cabinet coupling portion may include a spacer rib configured to contact a rear surface of the front flange. The frame bracket may include a side panel coupling portion located at an upper portion of the cabinet coupling portion and is configured to couple to the side panel. The side panel coupling portion may include a horizontal coupling surface and a coupling hole located at the horizontal coupling surface. The frame bracket may include a front panel coupling portion disposed in front of the side panel coupling portion and coupled to the front panel. The front panel coupling portion may include a vertical coupling surface that is configured to face the side panel and a coupling hole located at the coupling surface. The frame bracket may include an upper panel coupling portion, which is disposed behind the front panel coupling portion and configured to couple to the upper panel. The upper panel coupling portion may include a vertical coupling surface that is configured to face the rear panel and a coupling hole located at the coupling surface.

According to another aspect, a cooking appliance may include a cabinet with a cavity that defines a cooking space, an upper panel that is disposed above the cavity and that is configured to define an upper appearance of the cooking appliance, a front panel that is disposed in front of and above the cavity and that is configured to define a front appearance of the cooking appliance, a door that is configured to open and close the cavity, that is disposed below the front panel and that is configured to define, in conjunction with the front panel, a front appearance of the cooking appliance, a side panel that is disposed to the side of the cavity and that is configured to define a side appearance of the cooking appliance, a rear panel that is disposed to the back side of the cavity and that is configured to define a rear appearance of the cooking appliance, a frame bracket mounted to a front upper portion of the cabinet, and a link support that is disposed between the frame bracket and the rear panel, where the frame bracket includes a cavity coupling portion, an upper panel coupling portion, a front panel coupling portion and a side panel coupling portion, which are each respectively coupled to the cabinet, the upper panel, the front panel and the side panel.

Implementations according to this aspect may include one or more of the following features. For example, the frame bracket may include a link support coupling portion that is configured to couple to the link support to secure the rear panel to the cabinet via the link support. The coupling portions may be configured to have different heights. The cavity coupling portion and the front panel coupling portion may each include coupling surfaces that are parallel to the side panel. The upper panel coupling portion may include a coupling surface that is parallel to the rear panel. The side panel coupling portion and the link support coupling portion may each have coupling surfaces that are parallel to the upper panel.

DETAILED DESCRIPTION

Figure 1:
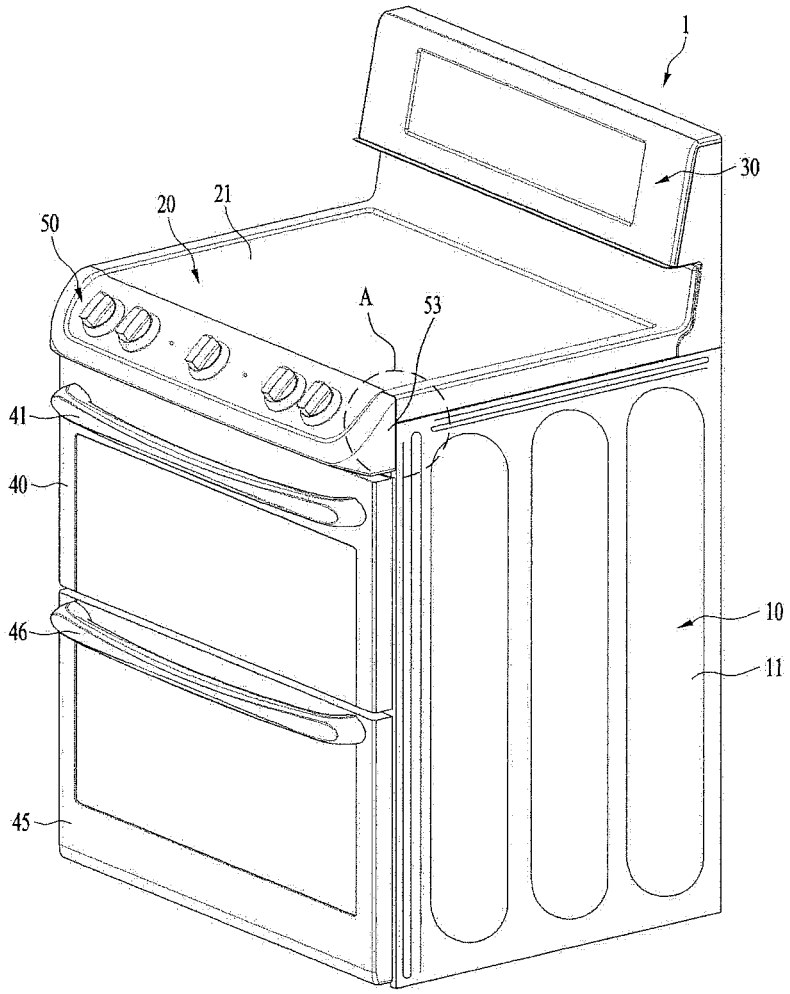
FIG. 1 is a perspective view illustrating an example of a cooking appliance.
Figure 2:
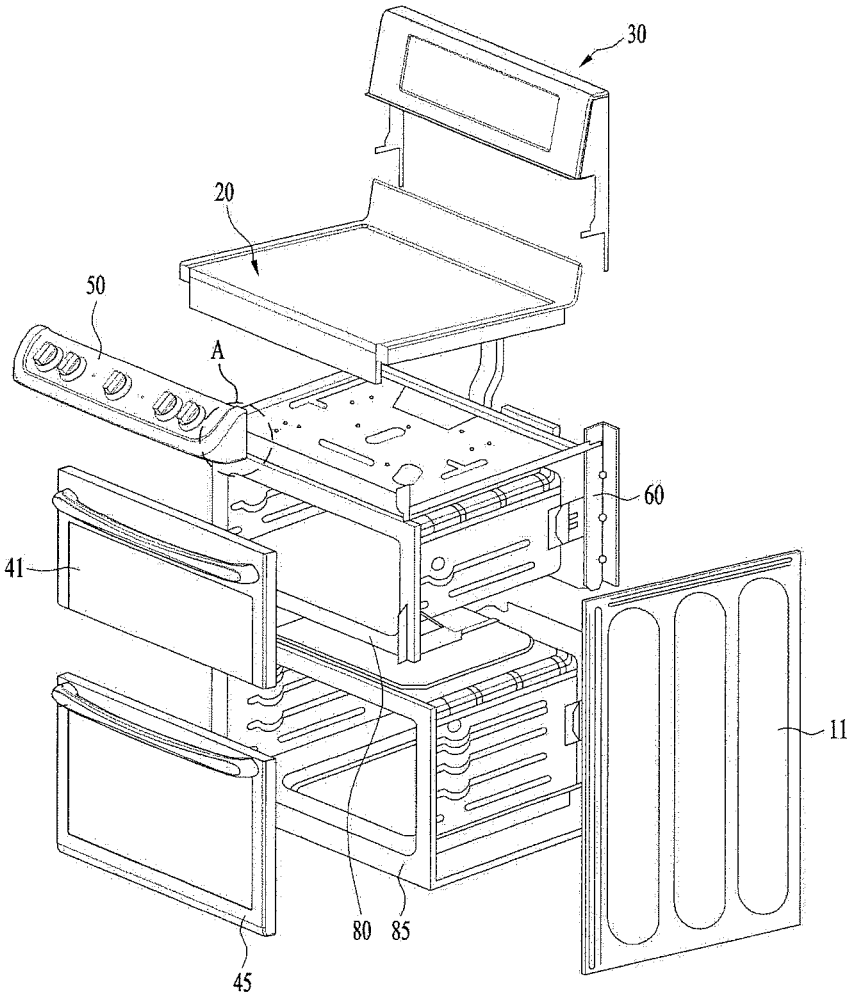
FIG. 2 is an exploded perspective view of the example of the cooking appliance illustrated in FIG. 1.

As illustrated in FIG. 1, a cooking appliance may include a cabinet 10. In some implementations, the cabinet may include one or more cooking spaces. The cabinet 10 may include side panels 11. The side panels 11 are respectively provided on both lateral side faces of the cooking appliance to constitute the external structure of the two lateral side faces. The cabinet 10 or the cavities 80 and 85 may be rotatably provided with doors 40 and 45. The cooking space inside the cavities 80 and 85 may be opened or closed by the doors 40 and 45. Specifically, a user may open or close the doors 40 and 45 while grasping handles 41 and 46. In the case in which a single cavity is provided, one door corresponding to the single cavity maybe provided.

The cooking appliance may include an upper panel 20 in addition to the cavities 80 and 85. The upper panel 20 may be formed on the upper face of the cooking appliance 1. The upper panel 20 may be a structure for defining a cook top, and may be referred to as a cook-top panel 20.

The cooking appliance may include a control panel 30, so that a user may manipulate the cooking appliance through the control panel 30. A user may check the state of operation of the cooking appliance through the control panel 30.

The cooking appliance may be provided at the rear face thereof with a rear panel 60. The rear panel 60 may be configured to block only a portion of the rear face of the cooking appliance, unlike the side panels 11. The rear panel 60 may be coupled to the rear face of the cavity.

The cooking appliance may be provided at the front face thereof with a front panel 50. The front panel 50 may be provided at the front upper area of the cooking appliance to allow a user to manipulate the heating source. The front panel 50 is disposed above the uppermost door 40 to define the front face of the cooking appliance in conjunction with the doors 40 and 45. The front panel 50 may be provided with a knob to be manipulated by a user.

The cooking appliance is configured to surround the cavities 80 and 85. The cavities may be modified into a single cavity. The front panel 50, the upper panel 20, the rear panel 60 and the side panels 11 are disposed around the cavities 80 and 85. Accordingly, the distances between the components, which define the cavities, determine the external dimensions of the cooking appliance. In other words, the distances between the components, which constitute the external structure of the cooking appliance, may be determined.

Region A in FIG. 1 may be considered to be a region at which the side panels 11, the front panel 50 and the upper panel 20 converge on one another. A gap attributable to assembly tolerance may occur in region A, and the gap may have an non-uniform size. Furthermore, a stepped portion may also occur in addition to the gap.

Such problems may also occur at other regions at which the components constituting the external structure of the cooking appliance are coupled to each other.

The cooking appliance according to this implementation may include a frame bracket 100, through which the plurality of panels are coupled to the cavity 80. The frame bracket 100 may be a structure that is secured to the cavity 80 and is coupled to at least two panels among the plurality of panels. Accordingly, the frame bracket 100 is a stationary structure, which is fixed with respect to the cavity 80, and at least two panels among the plurality of panels may be secured to the cavity 80 through the frame bracket 100.

Figure 3:
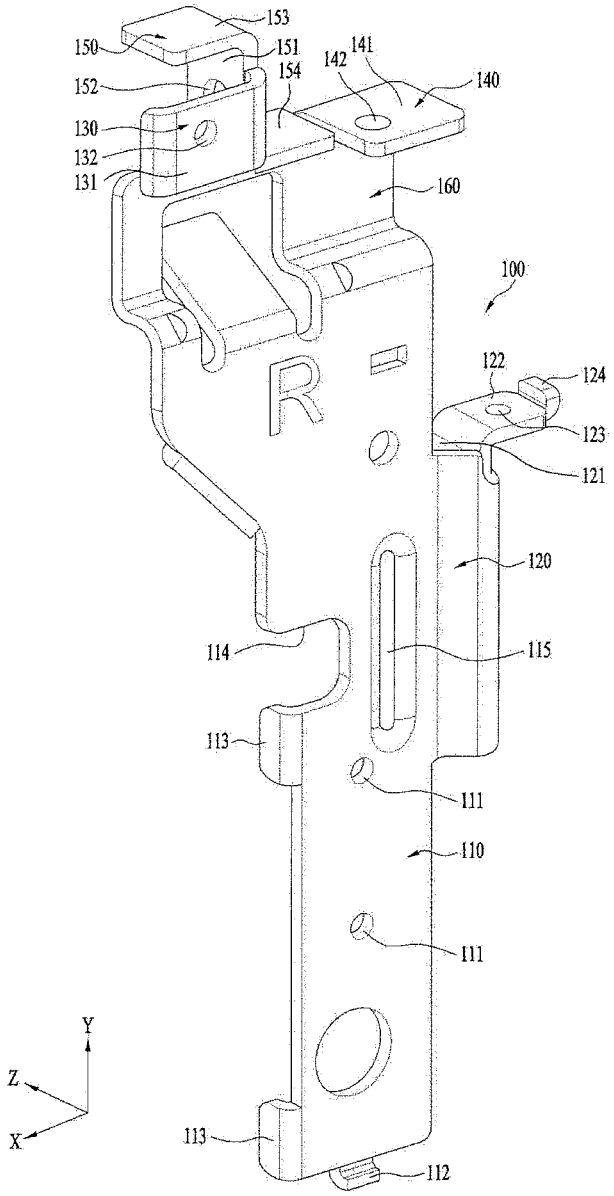
FIG. 3 is a perspective view illustrating a frame bracket of the cooking appliance.

As illustrated in FIG. 3, the frame bracket 100 may be considered to be a structure that is securely coupled to the cavity 80. Specifically, the frame bracket 100 may be securely provided at the front upper position of the cavity 80. The frame bracket 100 may be securely provided at a front upper position outside the cavity 80.

The frame bracket 100 may include a cavity coupling portion 110, and the frame bracket 100 may be secured to the cavity 80.

The cavity coupling portion 110 may be configured to have a plate shape, and may be coupled to the cavity in a surface-contact manner. The cavity coupling portion 110 may have coupling holes 111. The coupling holes 110 may include at least two coupling holes, which are vertically arranged. The cavity coupling portion 110 may be coupled to the cavity through the coupling holes 110. Screws may pass through the coupling holes 110. The frame bracket 100 may be coupled and secured to the cavity. Furthermore, the frame bracket 100 is able to sufficiently endure the torque in the z-axis direction in FIG. 3 while being secured to the cavity.

The cavity coupling portion 110 includes a fitting rib 112. The fitting rib 112 may be formed below the coupling holes 111. The fitting rib 112 may be formed at an edge of the cavity coupling portion 110, and may be positioned at the lowermost portion of the frame bracket 100. The fitting rib 112 may be formed by bending at least a portion of the end of the plate-shaped cavity coupling portion 110.

Spacer ribs 113 may be configured to have a form similar to the fitting rib 112. The cavity coupling portion 110 or the frame bracket 100 may include the spacer ribs 113.

As illustrated in FIG. 3, the cavity coupling portion 110 may be parallel to the x-y plane. The fitting rib 112 may be bent in the −z-axis direction, whereas the spacer ribs 113 may be bent in the +z-axis direction. The spacer ribs 113 have surfaces parallel to the z-y plane, and the surfaces come into surface contact with a portion of the outer surface of the cavity. Accordingly, the cavity coupling portion 110 may be temporarily secured to the cavity at the normal position by virtue of the space ribs 113 and the fitting rib 112. Subsequently, the cavity coupling portion 110 may be completely secured to the cavity by the screws.

The spacer ribs 113 may also include a plurality of spacer ribs, which are vertically arranged. The frame bracket 100 is able to sufficiently endure the torque in the z-axis direction due to the inclusion of the spacer ribs.

Figure 4:
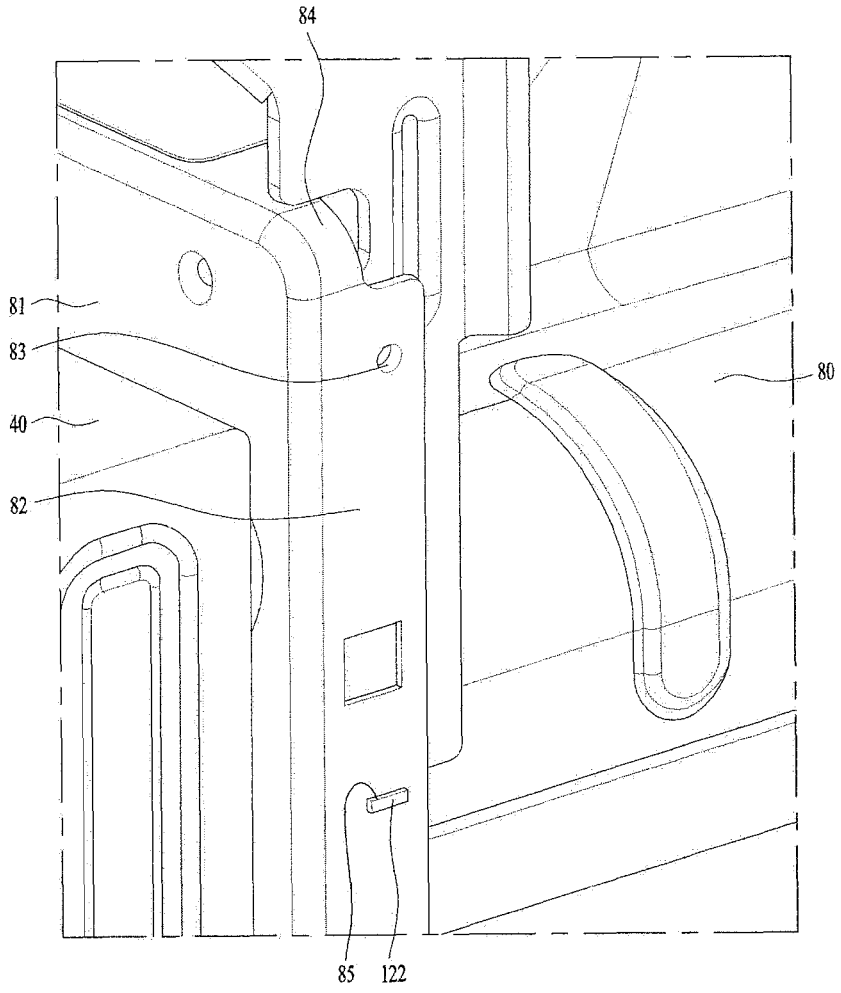
FIG. 4 is a fragmentary enlarged view illustrating the coupled state of a cavity and a frame bracket.

The cavity 80 is provided at the front face thereof with the door 40 for opening or closing the front opening in the cavity 80. In FIG. 4, the front opening in the cavity 80 (through which foodstuffs are put into and taken out of the cavity) is covered by the door 40.

A front flange 81 is provided at the outer marginal area of the front opening, and a side flange 82 is formed at the front flange 81 so as to extend rearward. The frame bracket 110 may be mounted in the upper corner of the cavity 80. As illustrated in FIG. 4, the frame bracket 110 may specifically be mounted in the upper left corner of the cavity 80. The frame bracket 110 may also be mounted in the upper right corner of the cavity 80 in a symmetric fashion.

In particular, the frame bracket 110 may be mounted on the side flange 82 in an surface contact manner. The side flange 82 may be provided with a fitting hole 85 into which the fitting rib 112 of the frame bracket 110 is fitted for positioning and temporary securement of the frame bracket 110.

The side flange 82 may have a coupling hole 83, which corresponds to the coupling hole 111 formed in the frame bracket 110. Accordingly, the frame bracket 110 may be securely coupled to the side flange 82 by screws which pass through the coupling holes 111 and 83. In other words, the frame bracket 110 may be securely coupled to the cavity 80.

In order to avoid interference with a corner 84, the frame bracket 110 may be provided with an avoidance cutout 114. Specifically, the cavity coupling portion 110 may include the avoidance cutout 114. The avoidance cutout 114 may be formed by cutting out a portion of the cavity coupling portion 110, and at least a portion of the corner 84 may be disposed in the avoidance cutout 114.

The cavity coupling portion 110 may be provided with a reinforcing portion 115, which is formed behind the avoidance cutout 114. The reinforcing portion 115 may be provided to compensate for a reduction in strength caused by the provision of the avoidance cutout 114. The region of the cavity coupling portion 110, at which the avoidance cutout 114 is provided, inevitably has reduced thickness or width, thereby deteriorating its resistance to bending. In order to compensate for the deterioration in bending resistance, a portion of the cavity coupling portion 110 may be depressed or bulged.

The frame bracket 110 may be coupled to a link support 70. To this end, the frame bracket 110 may include a link support coupling portion 120.

As illustrated in FIG. 3, the link support coupling portion 120 may be formed at a rear upper portion of the cavity coupling portion 110. The cavity coupling portion 110 may include a bent surface 121, which is bent and extends in the y-axis direction from the cavity coupling portion 110. The bent surface 121 may be configured to be substantially parallel to the z-y plane. The cavity coupling portion 110 may be provided on the bent surface 121 thereof with a link support coupling surface 122, which is bent from the bent surface 121 in the z-axis direction. The link support coupling surface 122 may be configured to b substantially parallel to the x-z plane.

The link support coupling surface 122 may be configured to be substantially parallel to the x-z plane. In other words, the link support coupling surface 122 may be configured to be parallel to the ground surface. The link support coupling surface 122 may be provided with a coupling hole 123 formed therein. At least a portion of the end of the link support coupling surface 122 may be bent so as to form a fitting rib 124.

Figure 5:
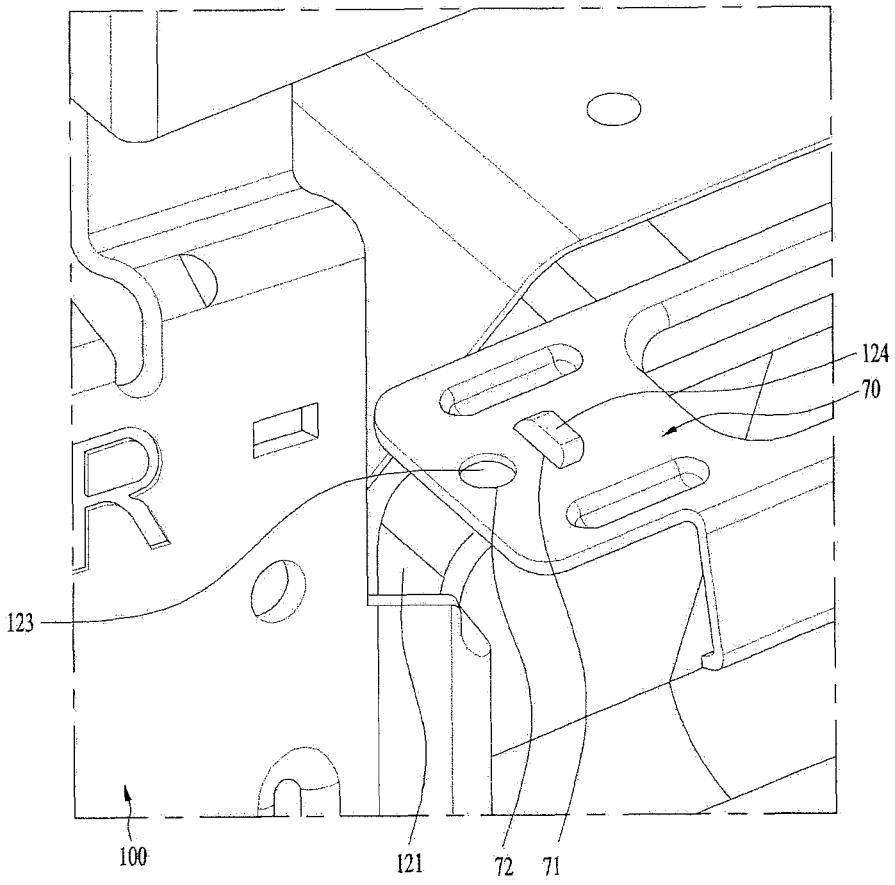
FIG. 5 is a fragmentary enlarged view illustrating the coupled state of a link support and the frame bracket.

As illustrated in FIG. 5, one end of the link support 70 may be seated on the link support coupling surface 122 in a surface-contact manner. The link support 70 may have a fitting hole 71. The link support 70 may be mounted on the link support coupling surface 122 by fitting the fitting rib 124 into the fitting hole 71.

The link support 70 may have a coupling hole 72 formed therein. The coupling hole 72 may correspond to the coupling hole 123 in the link support coupling portion 120. Accordingly, the one end of the link support 70 may be coupled to the frame bracket 100 by screws passing through the coupling holes 72 and 123.

The link support 70, which extends across the cooking appliance in the anteroposterior direction, may connect the rear panel 60 to the front portion of the cavity 80. In some examples, the link support 70 may be connected to the front portion of the cavity 80 through the frame bracket 100. In other words, by virtue of the link support 70, the positional reference point of the rear panel 60 may be formed at the frame bracket 100.

Figure 6:
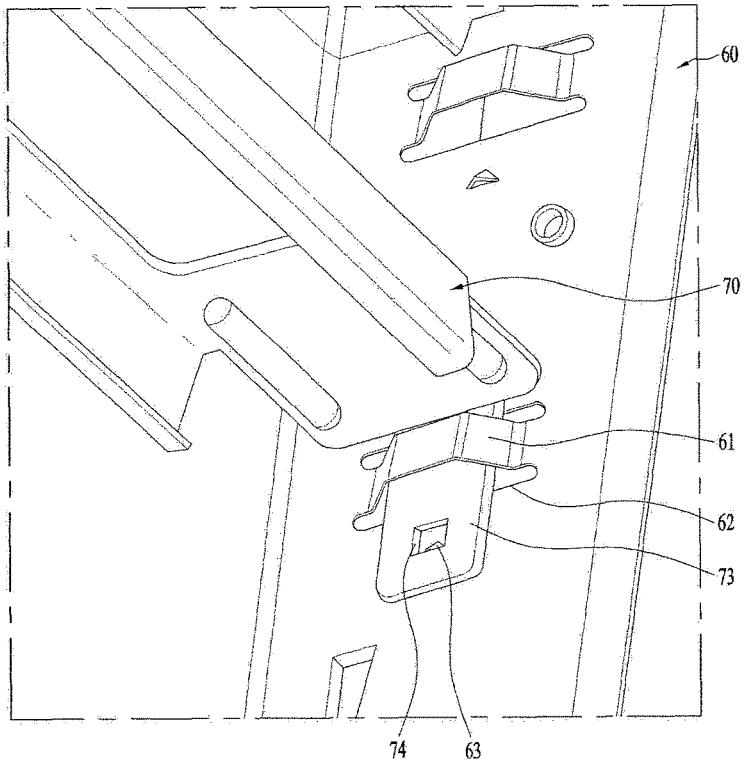
FIG. 6 is a fragmentary enlarged view illustrating the coupled state of the link support and a rear panel.

As illustrated in FIG. 6, the link support 70 may be provided with a fitting rib 73, and the rear panel 60 may be provided with a fitting slot 61 that corresponds to the fitting rib 73. The fitting rib 73 may have a fitting hole 74, and the rear panel 60 may be provided with a protrusion 74, which is fitted into the fitting hole 74. When the fitting rib 73 is completely fitted into the fitting slot 61, the protrusion 74 may be completely fitted into the fitting hole 74 and may protrude outward. Accordingly, the downward movement of the link support 70 may be restricted by interference between the link support 70 and the fitting slot 61, and the upward movement of the link support 70 may be restricted by interference between the protrusion 74 and the fitting hole 74.

Consequently, the one end of the link support 70 may be connected to the frame bracket 100, and the other end of the link support 70 may be connected to the rear panel 60.

As described above, the link support coupling portion 120 may be positioned at an upper portion of the cavity coupling portion 110. The link support coupling surface 122 may be positioned behind the cavity coupling portion 110, and may be configured to be parallel to the ground surface. Accordingly, even after the frame bracket 100 is first coupled to the cavity, the link support 70 may be easily coupled to the frame bracket 100.

The frame bracket 100 may be coupled to the side panel 11. To this end, the frame bracket 100 may include a side panel coupling portion 140.

As illustrated in FIG. 3, the side panel coupling portion 140 may be formed at the upper portion of the cavity coupling portion 110. Accordingly, after the frame bracket 100 is first coupled to the cavity, the side panel 11 may be easily coupled to the frame bracket 100. In the case in which the frame bracket 100 is provided with the link support coupling portion 120, the side panel coupling portion 140 may be positioned above the upper portion of the link support coupling portion 120. Accordingly, the coupling between the frame bracket 100 and the link support 70 and the coupling between the frame bracket 100 and the side panel 11 may be implemented without interference therebetween.

The frame bracket 100 may include an extension 160, which extends upward from the cavity coupling portion 110. The extension 160 may be formed so as to compensate for distances between the frame bracket 100 and other components positioned at the upper portion of the cavity 80. Furthermore, the extension 160 may also be formed such that the frame bracket 100 is coupled to other components with distances therebetween without interference between the frame bracket 100 and the other components.

The side panel coupling portion 140 may be provided at the end of the extension 160. The side panel coupling portion 140 may be bent and extend from the extension 160.

Figure 8:
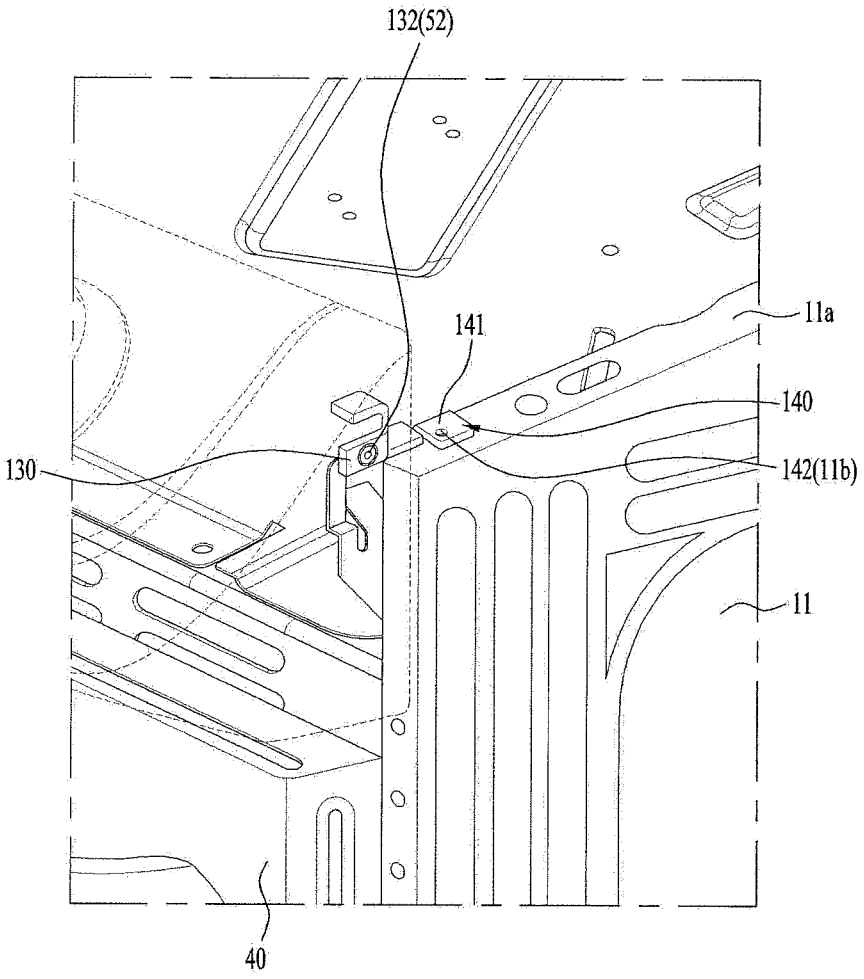
FIG. 8 is a fragmentary enlarged view illustrating the coupled state of a side panel and the frame bracket.

As illustrated in FIG. 8, the side panel coupling portion 140 may have a coupling surface 141. The coupling surface 141 may be configured to be substantially parallel to the ground surface. The side panel 11 may be provided with an upper flange 11*a*, which is in surface contact with the coupling surface 141. The upper flange 11*a* may also be configured to be substantially parallel to the ground surface.

The coupling surface 141 may have a coupling hole 142. The side panel 11 may have a coupling hole 11*b* corresponding to the coupling hole 142. The frame bracket 100 may be coupled to the side panel 11 by screws passing through the coupling holes 142 and 11*b*.

In the case in which the frame bracket 100 includes at least one of a front panel coupling portion 130 and an upper panel coupling portion 150, the side panel coupling portion 140 is preferably positioned behind the front panel coupling portion 130 or the upper panel coupling portion 150. In particular, the side panel coupling portion 140 is preferably positioned lower than the front panel coupling portion 130 or the upper panel coupling portion 150.

Consequently, after the frame bracket 100 is coupled to the side panel 11, the upper panel 50 or the upper panel 20 may be easily coupled to the frame bracket 100.

The frame bracket 100 may include the upper panel coupling portion 150 for coupling to the upper panel 20.

As illustrated in FIG. 3, the upper panel coupling portion 150 may be positioned at the uppermost portion of the frame bracket 100.

The upper panel coupling portion 150 may also include a coupling surface 151. The coupling surface 151 may have a coupling hole 152. The coupling surface 151 may be configured to be parallel to the z-y plane. In other words, the coupling surface 151 may be a vertical surface parallel to the front face of the cooking appliance.

Figure 9:
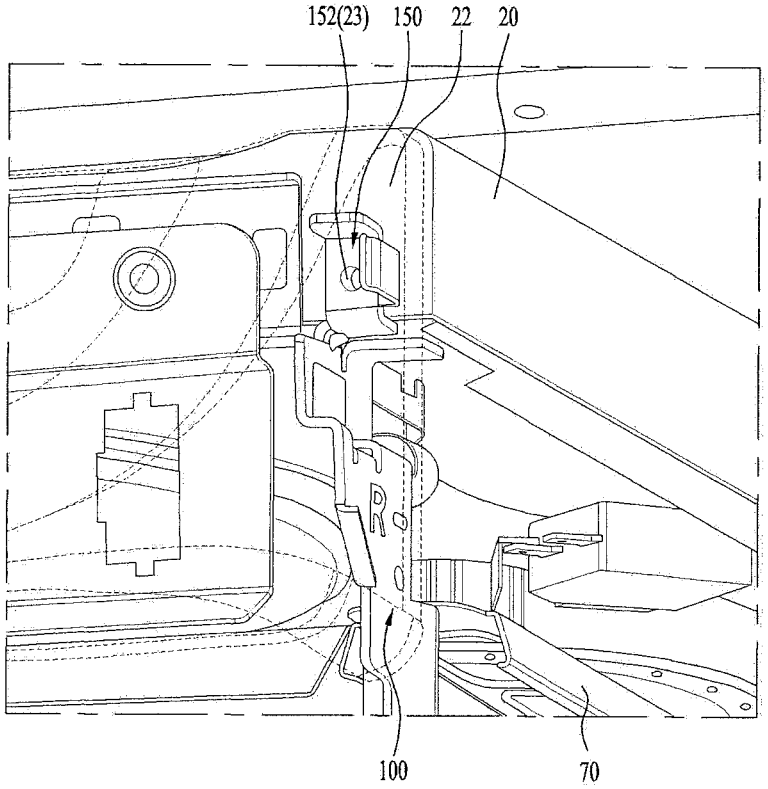
FIG. 9 is a fragmentary enlarged view illustrating the coupled state of an upper panel and the frame bracket.

As illustrated in FIG. 9, the upper panel 20 may be provided with a front flange 22. The front flange 22 may be configured to contact the coupling surface 151. In other words, the front flange 22 may be in surface contact with the coupling surface 151.

The coupling surface 151 may have therein a coupling hole 152, and the front flange 22 may have a coupling hole 23 corresponding to the coupling hole 152. Accordingly, the upper panel 20 may be coupled to the frame bracket 100 by screws passing through the coupling holes 152 and 23.

A support surface 154 may be provided behind the coupling surface 151 so as to be substantially perpendicular to the coupling surface 151. The support surface 154 may be configured to be substantially parallel to the ground surface. The upper panel 20 may be supported by the support surface 154. Forward movement of the upper panel 20 may be restricted by the coupling surface 151.

The upper panel 20 may be more stably coupled to the frame bracket 100, and the coupling therebetween may be reliably maintained. The support surface 154 may be configured to be parallel to the side panel coupling surface 141. However, the support surface 154 is preferably positioned higher than the side panel coupling surface 141. The reason for this is to prevent interference between the support surface 154 and a screw even when a portion of a screw protrudes upward from the side panel coupling surface 141.

A support surface 153, which is configured to be similar to the support surface 154, may be provided in front of the coupling surface 151. The support surface 153 may be configured to be substantially perpendicular to the coupling surface 151 and to be parallel to the ground surface. The support surface 153 may be bent forward from the upper end of the coupling surface 151.

The support surface 153 is preferably positioned higher than the support surface 154 adapted to support the upper panel 20. The support surface 153 may support the front panel 50, as will be described later. The support surface 153 may be configured to determine the position at which the front panel 50 is coupled.

The frame bracket 100 may include the front panel coupling portion 130. The front panel coupling portion 130 may be provided in front of and above the cavity coupling portion 110.

The front panel coupling portion 130 may include a coupling surface 131, which is parallel to the side panel 11. The coupling surface 131 may be configured to be parallel to the x-y plane. The coupling surface 132 may have a coupling hole 132 formed therein.

Figure 7:
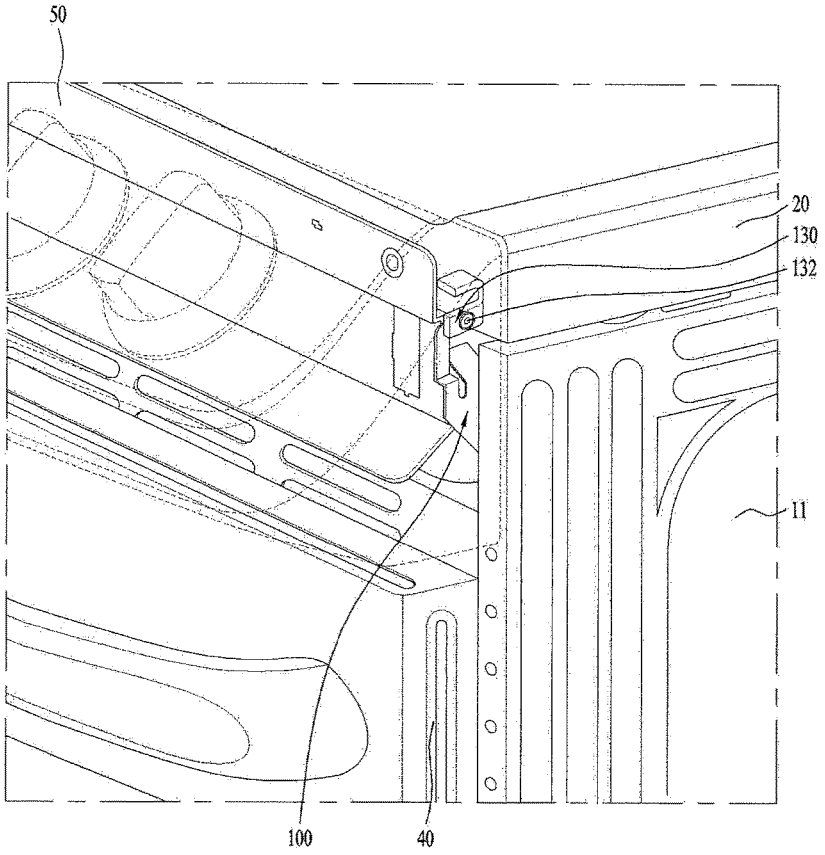
FIG. 7 is a fragmentary enlarged view illustrating the coupled state of a front panel and the frame bracket.

As illustrated in FIG. 7, the front panel 50 may be coupled to the frame bracket 100 in such a manner as to accommodate the frame bracket 100. The frame bracket 100 may be coupled to the front panel 50 while a side surface 53 of the front panel 50 covers the frame bracket 100.

The side surface 53 of the front panel 50 may be in surface contact with the coupling surface 131. The side surface 53 may have a coupling hole 52 corresponding to the coupling hole 132. The front panel 50 may be coupled to the frame bracket 100 by screws passing through the coupling holes 52 and 132.

The frame bracket 100 may be first coupled to the cavity 80, and may then be coupled to other components. In other words, the frame bracket 100 may be first coupled to the cavity 80, as illustrated in FIG. 4. Subsequently, the frame bracket 100 may be coupled to the link support 70, as illustrated in FIG. 5. Consequently, the distance between the rear panel 60 and the frame bracket 100 may be uniformly formed and may be maintained.

As illustrated in FIG. 8, the frame bracket 100 may be coupled to the side panel 11. Thereafter, the frame bracket 100 may be coupled to the upper panel 20, as illustrated in FIG. 9. Finally, the frame bracket 100 may be coupled to the front panel 50, as illustrated in FIG. 7.

The frame bracket 100 may include the cavity coupling portion 110, and may include coupling portions for coupling to at least two other components. The positions and heights of these components are preferably different from each other. Accordingly, after the frame bracket 100 is first coupled to the cavity coupling portion 110, the frame bracket 100 may be easily coupled to other components.

The coupling portions, which are formed on the frame bracket 100, are preferably coupled to the corresponding components in a surface-contact manner. Accordingly, it is possible to minimize gaps between the frame bracket 100 and other components even when external impacts or vibrations are applied thereto.

The frame bracket 100 is preferably constituted by a single body. In other words, it is preferable that a single structure or part be coupled to a plurality of components. Accordingly, it is possible to define a reference point between a plurality of components using a single frame bracket 100.

Although implementations have been illustrated and described above, it will be apparent to those skilled in the art that the implementations are provided to assist understanding of the present disclosure and the present disclosure is not limited to the above described implementations. Various modifications and variations can be made without departing from the spirit or scope of the present disclosure.

What is claimed is:

1. A cooking appliance comprising:

a cabinet with a cavity that defines a cooking space;

an upper panel that is disposed above the cavity and that is configured to define an upper appearance of the cooking appliance;

a front panel that is disposed in front of the cavity and that is configured to define a front appearance of the cooking appliance;

a door that is configured to open and close the cavity, that is disposed below the front panel and that is configured to define, in conjunction with the front panel, the front appearance of the cooking appliance;

a side panel that is disposed on a side of the cavity and that is configured to define a side appearance of the cooking appliance;

a rear panel that is disposed behind the cavity and that is configured to define a rear appearance of the cooking appliance; and a frame bracket that is mounted to a front upper portion of the cabinet and that is configured to secure the upper and front panels to the cabinet.

2. The cooking appliance according to claim 1, wherein the frame bracket is coupled to the side panel and is configured to secure the upper panel, the front panel and the side panel to the cabinet.

3. The cooking appliance according to claim 2, further comprising a link support, wherein a first end of the link support is coupled to the frame bracket, and a second end of the link support is coupled to the rear panel.

4. The cooking appliance according to claim 1, wherein the frame bracket includes a pair of frame brackets each respectively provided on the lateral sides of the cavity.

5. The cooking appliance according to claim 1, wherein the frame bracket is a single body.

6. The cooking appliance according to claim 5, wherein the frame bracket includes a cabinet coupling portion that is configured to couple to the cabinet from outside the cabinet.

7. The cooking appliance according to claim 6, wherein the cavity coupling portion is configured to be in surface contact with a side flange located at a front portion of the cavity.

8. The cooking appliance according to claim 7, wherein the side flange includes a through hole, and the cabinet coupling portion includes a fitting rib that is configured to fit into the through hole.

9. The cooking appliance according to claim 8, wherein the cabinet coupling portion includes a coupling hole above the fitting rib, and the side flange includes a coupling hole that is configured to correspond the coupling hole of the cabinet coupling portion.

10. The cooking appliance according to claim 7, wherein the side flange is configured to bent in a rearward direction from an outer edge of a front flange located at a front surface of the cavity, and the cabinet coupling portion includes a spacer rib configured to contact a rear surface of the front flange.

11. The cooking appliance according to claim 5, wherein the frame bracket includes a side panel coupling portion located at an upper portion of the cabinet coupling portion and is configured to couple to the side panel.

12. The cooking appliance according to claim 11, wherein the side panel coupling portion includes a horizontal coupling surface and a coupling hole located at the horizontal coupling surface.

13. The cooking appliance according to claim 1, wherein the frame bracket includes a front panel coupling portion disposed in front of the side panel coupling portion and coupled to the front panel.

14. The cooking appliance according to claim 13, wherein the front panel coupling portion includes a vertical coupling surface that is configured to face the side panel and a coupling hole located at the coupling surface.

15. The cooking appliance according to claim 13, wherein the frame bracket includes an upper panel coupling portion, which is disposed behind the front panel coupling portion and configured to couple to the upper panel.

16. The cooking appliance according to claim 15, wherein the upper panel coupling portion includes a vertical coupling surface that is configured to face the rear panel and a coupling hole located at the coupling surface.

17. A cooking appliance comprising:

a cabinet with a cavity that defines a cooking space;

an upper panel that is disposed above the cavity and that is configured to define an upper appearance of the cooking appliance;

a front panel that is disposed in front of and above the cavity and that is configured to define a front appearance of the cooking appliance;

a door that is configured to open and close the cavity, that is disposed below the front panel and that is configured to define, in conjunction with the front panel, a front appearance of the cooking appliance;

a side panel that is disposed to the side of the cavity and that is configured to define a side appearance of the cooking appliance;

a rear panel that is disposed to the back side of the cavity and that is configured to define a rear appearance of the cooking appliance;

a frame bracket mounted to a front upper portion of the cabinet; and a link support that is disposed between the frame bracket and the rear panel, wherein the frame bracket includes a cavity coupling portion, an upper panel coupling portion, a front panel coupling portion and a side panel coupling portion, which are each respectively coupled to the cabinet, the upper panel, the front panel and the side panel.

18. The cooking appliance according to claim 16, wherein the frame bracket includes a link support coupling portion that is configured to couple to the link support to secure the rear panel to the cabinet via the link support.

19. The cooking appliance according to claim 16, wherein the coupling portions are configured to have different heights.

20. The cooking appliance according to claim 16, wherein the cavity coupling portion and the front panel coupling portion each include coupling surfaces that are parallel to the side panel.

21. The cooking appliance according to claim 16, wherein the upper panel coupling portion includes a coupling surface that is parallel to the rear panel.

22. The cooking appliance according to claim 16, wherein the side panel coupling portion and the link support coupling portion each have coupling surfaces that are parallel to the upper panel.

* * * * *